US011021926B2

(12) United States Patent
Smith et al.

(10) Patent No.: US 11,021,926 B2
(45) Date of Patent: Jun. 1, 2021

(54) APPARATUS, SYSTEM, AND METHOD FOR ISOLATING A TUBING STRING

(71) Applicant: PetroFrac Oil Tools, Waller, TX (US)

(72) Inventors: Roddie R. Smith, Katy, TX (US); Tony Flores, Waller, TX (US); Lee Emerson, Waller, TX (US); Robert Joe Coon, Missouri City, TX (US)

(73) Assignee: PETROFRAC OIL TOOLS, Waller, TX (US)

( * ) Notice: Subject to any disclaimer, the term of this patent is extended or adjusted under 35 U.S.C. 154(b) by 21 days.

(21) Appl. No.: 16/514,794

(22) Filed: Jul. 17, 2019

(65) Prior Publication Data

US 2020/0032610 A1 Jan. 30, 2020

Related U.S. Application Data

(60) Provisional application No. 62/702,744, filed on Jul. 24, 2018.

(51) Int. Cl.
*E21B 33/12* (2006.01)
*E21B 29/02* (2006.01)

(52) U.S. Cl.
CPC ..... *E21B 33/12* (2013.01); *E21B 29/02* (2013.01)

(58) Field of Classification Search
CPC ..... E21B 33/12; E21B 33/128; E21B 33/129; E21B 33/1292; E21B 33/12955; E21B 29/02; E21B 23/04; E21B 23/0411; E21B 23/042; E21B 23/06
See application file for complete search history.

(56) References Cited

U.S. PATENT DOCUMENTS 2,921,632 A 1/1906 Clark, Jr.
2,989,087 A 6/1961 Higgins
3,000,443 A 9/1961 Thompson
(Continued)

FOREIGN PATENT DOCUMENTS

CA 2810045 A1 9/2013
WO 2012-045168 A1 4/2012
(Continued)

OTHER PUBLICATIONS

PCT/US2017/036252—International Search Report and Written Opinion of the International Searching Authority, dated Sep. 21, 2017, 20 pages.
(Continued)

*Primary Examiner* — Michael R Wills, III
(74) *Attorney, Agent, or Firm* — Nolte Lackenbach Siegel

(57) ABSTRACT

An apparatus, system and method are provided for isolating a portion of a tubing string in a hydrocarbon well. The portion of isolated tubing string can be used to set a packer or test tubing integrity hydrostatically. The apparatus includes a dissolvable valve that is installed in a nipple and positioned below the portion of tubing string. The dissolvable valve includes a ball seat for receiving a dissolvable ball. When the dissolvable ball is dropped into the tubing string and seated on the ball seat of the dissolvable valve, the portion of tubing string is isolated from a second portion of tubing string below the nipple. Wellbore fluids in the hydrocarbon well dissolve the dissolvable valve and the dissolvable ball to leave behind a nipple without any restrictions.

19 Claims, 5 Drawing Sheets

(56) References Cited

U.S. PATENT DOCUMENTS

| | | | |
|---|---|---|---|
| 3,051,243 | A | 8/1962 | Grimmer et al. |
| 3,090,442 | A | 5/1963 | Cochran |
| 3,151,681 | A | 10/1964 | Cochran |
| 3,166,128 | A | 1/1965 | Myers et al. |
| 3,298,440 | A | 1/1967 | Current |
| 3,358,766 | A | 12/1967 | Current |
| 3,845,815 | A | 11/1974 | Garwood |
| 3,939,519 | A | 2/1976 | Muirhead |
| 4,114,694 | A | 9/1978 | Dinning |
| 4,176,715 | A | 12/1979 | Bigelow |
| 4,436,152 | A | 3/1984 | Fisher, Jr. et al. |
| 4,487,221 | A | 12/1984 | Zwart |
| 4,510,994 | A | 4/1985 | Pringle |
| 4,730,835 | A | 3/1988 | Wilcox |
| 4,765,404 | A | 8/1988 | Bailey |
| 4,784,226 | A | 11/1988 | Wyatt |
| 4,896,721 | A | 1/1990 | Welch |
| 4,901,794 | A | 2/1990 | Baugh |
| 4,903,777 | A | 2/1990 | Jordan, Jr. |
| 4,917,191 | A | 4/1990 | Hopmann et al. |
| 4,934,452 | A | 6/1990 | Bradley |
| 5,012,867 | A | 5/1991 | Kilgore et al. |
| 5,156,220 | A | 10/1992 | Forehand et al. |
| 5,174,379 | A | 12/1992 | Whitely et al. |
| 5,183,114 | A | 2/1993 | Mashaw et al. |
| 5,263,683 | A | 11/1993 | Wong |
| 5,305,828 | A | 4/1994 | White et al. |
| 5,305,833 | A | 4/1994 | Collins |
| 5,309,993 | A | 5/1994 | Coon et al. |
| 5,316,084 | A | 5/1994 | Murray et al. |
| 5,390,736 | A | 2/1995 | Budde |
| 5,511,617 | A | 4/1996 | Snider et al. |
| 5,542,473 | A | 8/1996 | Pringle |
| 5,549,161 | A | 8/1996 | Gomez et al. |
| 5,641,023 | A | 6/1997 | Ross et al. |
| 5,678,633 | A | 10/1997 | Constantine, Jr. |
| 5,826,652 | A | 10/1998 | Tapp |
| 5,921,318 | A | 7/1999 | Ross |
| 5,927,402 | A | 7/1999 | Benson et al. |
| 5,960,879 | A | 10/1999 | Echols |
| 5,967,816 | A | 10/1999 | Sampa et al. |
| 6,189,619 | B1 | 2/2001 | Wyatt et al. |
| 6,224,112 | B1 | 5/2001 | Eriksen et al. |
| 6,237,686 | B1 | 5/2001 | Ryll et al. |
| 6,302,217 | B1 | 10/2001 | Kilgore et al. |
| 6,318,729 | B1 | 11/2001 | Pitts, Jr. et al. |
| 6,561,270 | B1 | 5/2003 | Budde |
| 6,631,768 | B2 | 10/2003 | Patel et al. |
| 6,722,439 | B2 | 4/2004 | Garay et al. |
| 6,866,100 | B2 | 3/2005 | Gudmedstad et al. |
| 6,983,796 | B2 | 1/2006 | Bayne et al. |
| 7,191,843 | B2 | 3/2007 | Wong |
| 7,472,753 | B2 | 1/2009 | Mondelli et al. |
| 7,921,922 | B2 | 4/2011 | Darnell et al. |
| 8,079,413 | B2 | 12/2011 | Frazier |
| 8,336,616 | B1 | 12/2012 | McClinton |
| 8,899,335 | B2 | 12/2014 | Churchill |
| 9,133,698 | B2 | 9/2015 | Myers et al. |
| 9,309,733 | B2 | 4/2016 | Xu |
| 9,657,547 | B2 | 5/2017 | Raggio |
| 9,835,003 | B2 | 12/2017 | Harris et al. |
| 9,845,658 | B1 | 12/2017 | Nish et al. |
| 9,976,379 | B2 | 5/2018 | Schmidt et al. |
| 10,000,991 | B2 | 6/2018 | Harris |
| 10,053,945 | B2 | 8/2018 | Acosta et al. |
| 10,309,189 | B1 | 6/2019 | Branton |
| 2003/0056951 | A1 | 3/2003 | Kaszuba |
| 2004/0104025 | A1 | 6/2004 | Mikolajczyk |
| 2005/0199401 | A1 | 9/2005 | Patel |
| 2006/0237186 | A1 | 10/2006 | Mondelli et al. |
| 2008/0169105 | A1 | 7/2008 | Williamson et al. |
| 2008/0217000 | A1 | 9/2008 | Palmer et al. |
| 2008/0308266 | A1 | 12/2008 | Roberts et al. |
| 2009/0025930 | A1 | 1/2009 | Iblings et al. |
| 2009/0044957 | A1 | 2/2009 | Clayton |
| 2010/0032151 | A1* | 2/2010 | Duphorne ..... E21B 33/134 166/55 |
| 2010/0051293 | A1 | 3/2010 | Ezell et al. |
| 2010/0132960 | A1 | 6/2010 | Shkurti et al. |
| 2011/0088891 | A1 | 4/2011 | Stout |
| 2011/0115168 | A1 | 5/2011 | Miller et al. |
| 2011/0147015 | A1 | 6/2011 | Mickey |
| 2011/0180273 | A1 | 7/2011 | Hughes et al. |
| 2011/0259610 | A1 | 10/2011 | Shkurti et al. |
| 2012/0267099 | A1 | 10/2012 | Simson et al. |
| 2013/0186647 | A1 | 7/2013 | Xu et al. |
| 2013/0192853 | A1 | 8/2013 | Themig et al. |
| 2013/0233535 | A1* | 9/2013 | Pacey ..... E21B 33/12 166/206 |
| 2013/0240203 | A1 | 9/2013 | Frazier |
| 2014/0124192 | A1 | 5/2014 | Robinson |
| 2014/0216754 | A1 | 8/2014 | Richard et al. |
| 2014/0224479 | A1 | 8/2014 | Andrigo |
| 2015/0021012 | A1 | 1/2015 | Gerrard |
| 2015/0075774 | A1 | 3/2015 | Raggio |
| 2015/0247376 | A1 | 9/2015 | Tolman et al. |
| 2015/0308215 | A1 | 10/2015 | Kellner et al. |
| 2015/0361756 | A1 | 12/2015 | Frazier |
| 2016/0061001 | A1 | 3/2016 | Fitzhugh et al. |
| 2016/0186511 | A1 | 6/2016 | Corondado et al. |
| 2016/0208575 | A1 | 7/2016 | Bellavance et al. |
| 2016/0222755 | A1 | 8/2016 | Angman |
| 2016/0251937 | A1 | 9/2016 | Fripp |
| 2016/0305215 | A1 | 10/2016 | Harris et al. |
| 2016/0376869 | A1 | 12/2016 | Rochen et al. |
| 2017/0022780 | A1 | 1/2017 | Berry |
| 2017/0145781 | A1 | 5/2017 | Silva |
| 2017/0158942 | A1 | 6/2017 | Okura et al. |
| 2017/0175487 | A1* | 6/2017 | Marcin ..... E21B 33/12 |
| 2017/0191340 | A1 | 7/2017 | Deng |
| 2017/0204700 | A1* | 7/2017 | Hughes ..... E21B 43/14 |
| 2017/0218722 | A1 | 8/2017 | Gordon et al. |
| 2017/0268310 | A1 | 9/2017 | Shkurti |
| 2017/0356268 | A1 | 12/2017 | Smith et al. |
| 2017/0362912 | A1 | 12/2017 | Smith et al. |
| 2017/0370176 | A1 | 12/2017 | Frazier |
| 2018/0016864 | A1 | 1/2018 | Parekh et al. |
| 2018/0023362 | A1 | 1/2018 | Makowiecki et al. |
| 2018/0051532 | A1 | 2/2018 | Smith et al. |
| 2018/0128074 | A1 | 5/2018 | Frazier |
| 2018/0135380 | A1 | 5/2018 | Saulou et al. |
| 2018/0171745 | A1 | 6/2018 | Jones |
| 2018/0171746 | A1 | 6/2018 | Dudzinski et al. |
| 2018/0328130 | A1 | 11/2018 | Smith et al. |
| 2018/0328136 | A1 | 11/2018 | Smith et al. |
| 2018/0328137 | A1 | 11/2018 | Smith et al. |
| 2019/0024498 | A1 | 1/2019 | Coon et al. |

FOREIGN PATENT DOCUMENTS

| | | | |
|---|---|---|---|
| WO | 2017-218321 | A1 | 9/2013 |
| WO | 2015-076831 | A1 | 4/2016 |
| WO | 2016-065291 | A1 | 12/2017 |

OTHER PUBLICATIONS

PCT/US2017/036692—International Search Report and Written Opinion of he International Searching Authority, dated Jun. 9, 2017, 17 pages.

PCT/US2017/036729—International Search Report and Written Opinion of he International Searching Authority, dated Jun. 9, 2017, 17 pages.

PCT/US2017/036736—International Search Report and Written Opinion of he International Searching Authority, dated Jun. 9, 2017, 16 pages.

PCT/US2017/036742—International Search Report and Written Opinion of he International Searching Authority, dated Jun. 9, 2017, 18 pages.

(56) References Cited

OTHER PUBLICATIONS

PCT/US2018/045777—International Search Report and Written Opinion of the International Searching Authority, dated Nov. 22, 2018, 15 pages.

* cited by examiner

APPARATUS, SYSTEM, AND METHOD FOR ISOLATING A TUBING STRING

CROSS-REFERENCE TO RELATED APPLICATIONS

This application claims the benefit of U.S. Provisional Patent Application having Ser. No. 62/702,744 which was filed Jul. 24, 2018. The aforementioned patent application is hereby incorporated by reference in its entirety into the present application to the extent consistent with the present application.

BACKGROUND

Packers are often used in oil and gas wells to isolate an area of casing or tubing within a wellbore. Packers typically include slips with gripping teeth that engage an inner diameter of the casing or tubing when an axial load is applied to the packer, thereby actuating the packer. Hydraulic pressure is often used to produce the axial load to actuate the packer. When hydraulic pressure is used to actuate the packer, the casing or tubing below the packer must be closed.

A common way to isolate the casing or tubing below the packer or any tubing string needing isolation is to position a nipple in the casing or tubing below the packer or tubing string needing isolation and position a standing valve within the nipple. The standing valve may be a check valve that includes a trapped ball to open and close the standing valve. The trapped ball may prevent fluid and/or pressure from flowing through the standing valve to the casing or tubing below the standing valve thereby isolating the packer above the standing valve. However, the trapped ball may allow fluid and/or pressure to pass through and/or above the standing valve for pressure relief. Once the packer is set or there is no longer a need for isolation in the casing or tubing, the standing valve may be pulled out of the casing or tubing by wireline. However, the nipple positioned below the packer or the tubing string remains in the casing or tubing below, which results in a permanent restriction within the casing or tubing below the packer or the tubing string.

Therefore, there is a need for a device and method that may isolate a packer or tubing string without leaving a restriction in the casing or tubing below the packer or tubing string and be removed without well intervention.

SUMMARY

One embodiment of the invention may include a valve for isolating a portion of tubing string in a hydrocarbon well. The valve may include a valve body that includes a ball seat, an anchor that is positioned on the valve body, and a ball that is configured to seat on the ball seat of the valve body. The anchor may be configured to position the valve within a nipple that is positioned below the portion of tubing string. The valve body, the anchor, and the ball may be constructed from a dissolvable material.

Another embodiment of the invention may include a system for isolating a portion of tubing string in a hydrocarbon well. The system may include a nipple including an inner surface that defines a groove, a dissolvable valve including a valve body that includes a ball seat, an anchor that is positioned on the valve body and fits in the groove of the nipple, and a dissolvable ball configured to seat on the ball seat.

Another embodiment of the invention may include a method for isolating a portion of tubing string in a hydrocarbon well. The method may include positioning a dissolvable valve within a nipple. The dissolvable valve may include a ball seat. The method may further include positioning the nipple below the portion of tubing string in the hydrocarbon well and seating a dissolvable ball on the ball seat.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
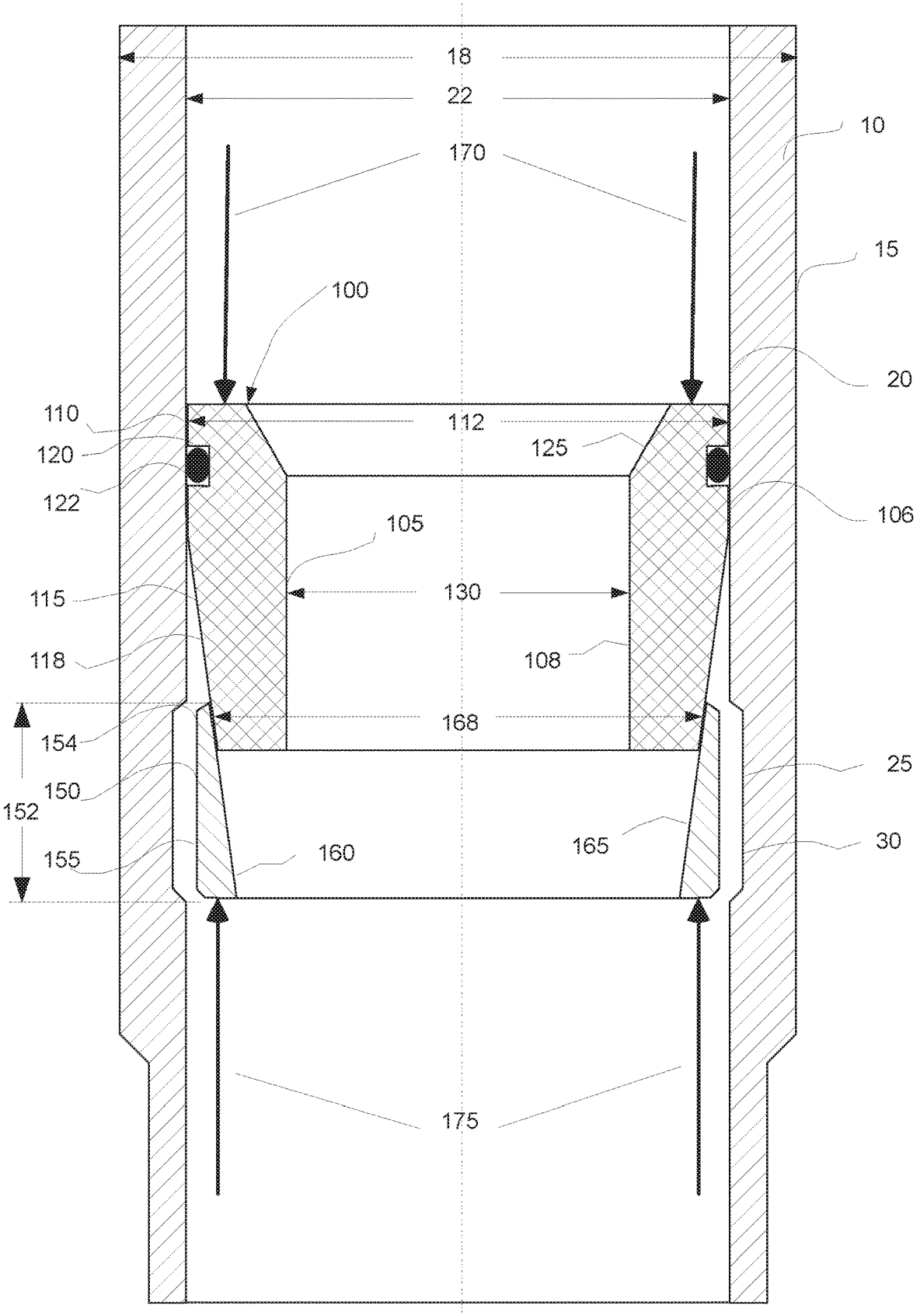
FIG. 1 is a cross-sectional view of an apparatus for isolating a portion of tubing string prior to assembly, according to one or more embodiments disclosed herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Embodiments of the invention could be used in a variety of oil and gas applications, which could include both vertical and directional wells. Accordingly, position terminology such as "above" and "below" should be interpreted relative to the tubing string opening at the surface of the earth, where "above" is in a position closer to the opening at the surface of the earth, and "below" is in a position further from the opening at the surface of the earth. The terms "upstream" and "downstream" are to be interpreted relative to the direction of flow. Upstream is against the flow and downstream is with the flow. Accordingly, if component A is upstream of component B, component A is closer to the toe or end of the well than component B. The most upstream portion of the well is the end of farthest portion of the tubing string away from the surface.

Embodiments of the disclosure generally provide an apparatus, system, and method for isolating a tubing string in a hydrocarbon well. The apparatus, which may be a dissolvable valve, may be pre-installed in a nipple that is positioned below the portion of tubing string. The dissolvable valve may be constructed of a dissolvable material and may include a ball seat. The dissolvable valve may be actuated by dropping a dissolvable ball down the tubing string to seat on the ball seat. Upon actuation, the dissolvable valve may prevent fluid from flowing past the ball seat in a downhole direction. As wellbore and production fluids come in contact with the dissolvable valve and the dissolvable ball, the dissolvable valve and the dissolvable ball may dissolve completely leaving no restriction within the nipple positioned below the portion of tubing string.

FIG. 1 is a cross-sectional view of a device for isolating a portion of tubing string, according to one embodiment disclosed herein. The device may include a dissolvable valve 100 that may be positioned within a nipple 10. In one embodiment, the dissolvable valve 100 may be pre-installed in the nipple 10 before it is run in a wellbore on a tubing string. The nipple 10 may be substantially cylindrical and may include an outer surface 15 with an outer diameter 18 and an inner surface 20 with an inner diameter 22. The inner surface 20 of the nipple 10 may further define a groove 25 that is configured to receive an anchor 150 of the dissolvable valve 100 when the dissolvable valve 100 is positioned within the nipple 10.

The dissolvable valve 100 may include a valve body 105 and the anchor 150 for positioning within the nipple 10. Both the valve body 105 and the anchor 150 may be constructed from a dissolvable material. The dissolvable material may be a dissolvable plastic like polyglycolic acid ("PGA"), a dissolvable metal such as magnesium aluminum alloy or aluminum alloy, a combination of dissolvable plastic and dissolvable metal, or any other dissolvable material suitable for a hydrocarbon well.

Figure 2:
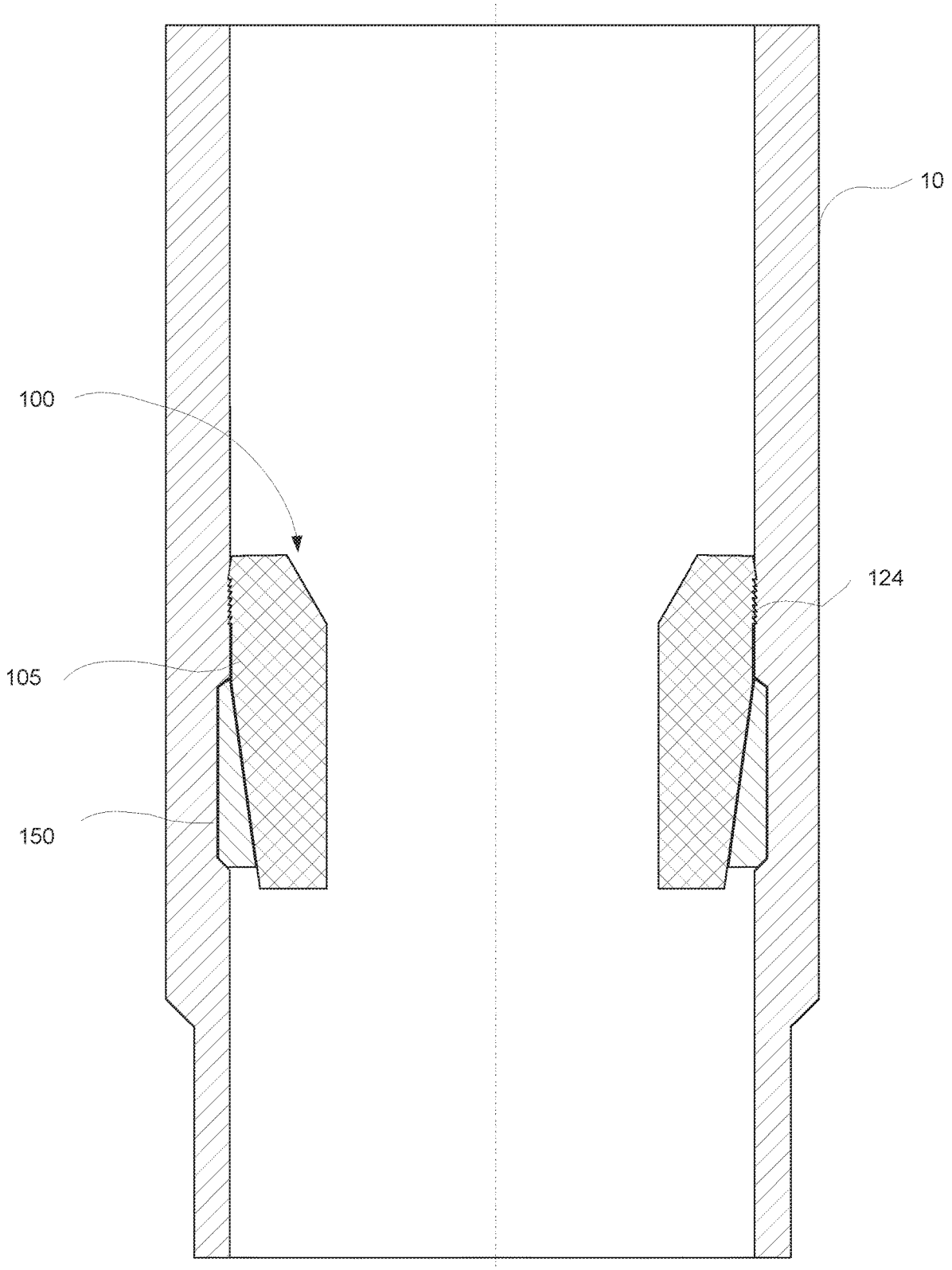
FIG. 2 is a cross-sectional view of another apparatus for isolating a apportion of tubing string, according to one or more embodiments disclosed herein.

The valve body 105 may include a valve outer surface 106 and a valve inner surface 108. The valve body 105 may further include an upper portion 110 and a lower portion 115. The valve outer surface 106 may include an upper outer diameter 112, and the upper outer diameter 112 may be substantially the same (within +/−10%) as the inner diameter 22 of the nipple 10. The valve outer surface 106 at the upper portion 110 may define a valve groove 120 that is configured to receive a seal 122. The seal 122 may provide a seal between the dissolvable valve 100 and the nipple 10. In one embodiment, the seal 122 may consist of a dissolvable material. Alternatively, and as shown in FIG. 2, the valve outer surface 106 may include teeth 124 that may be used to provide a seal between the dissolvable valve 100 and the nipple 10.

Figure 4:
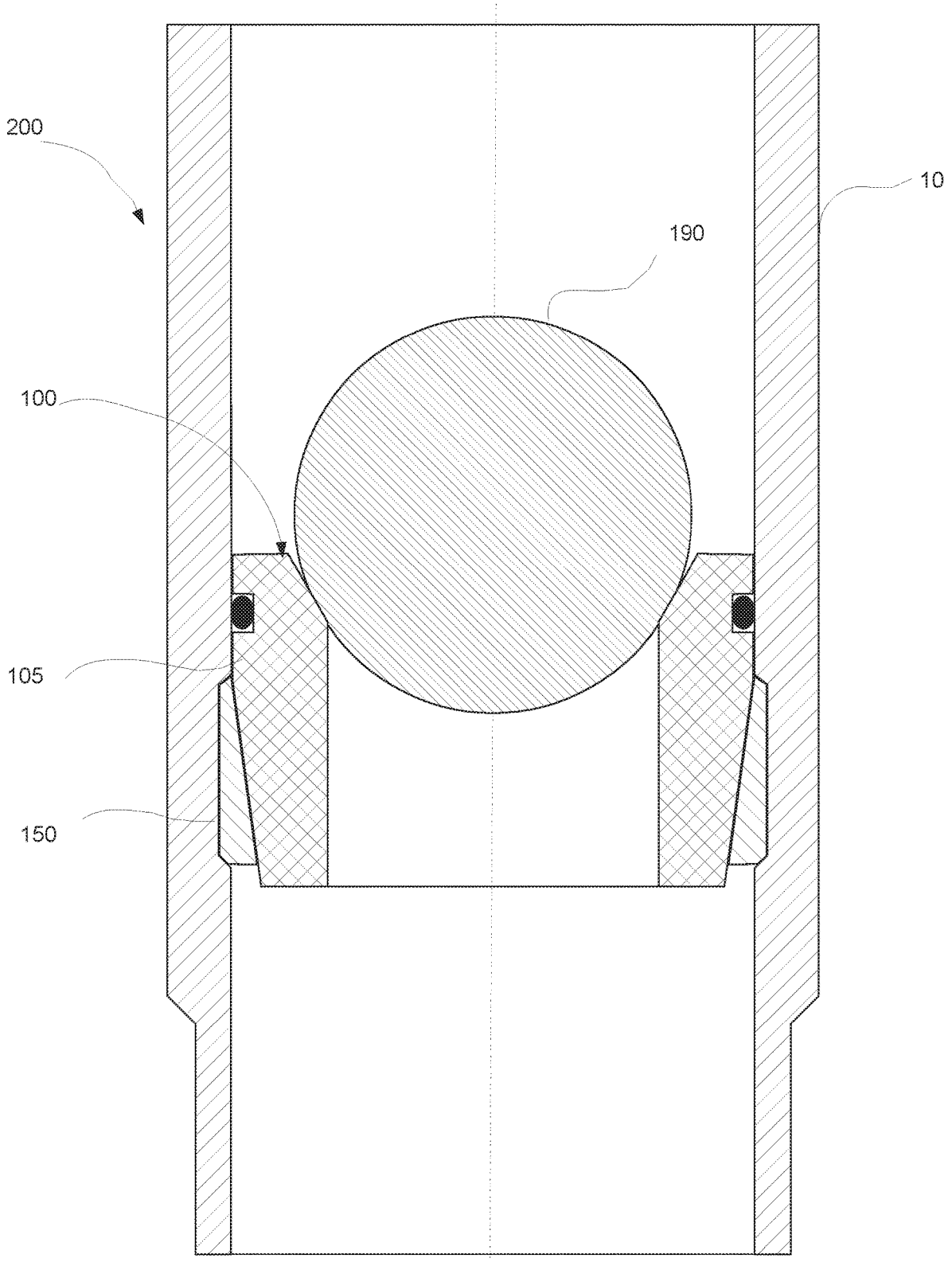
FIG. 4 is a cross-sectional view of an apparatus and system for isolating a portion of tubing string after actuation, according to one or more embodiments disclosed herein.

The inner surface 108 of the upper portion 110 of the valve body 105 may define a ball seat 125 that is configured to receive a ball 190 (shown in FIG. 4). The valve outer surface 106 at the lower portion 115 may include a tapered outer surface 118 where the outer diameter decreases along a length of the valve body 105. The lower portion 115 of the valve body 105 may include an inner diameter 130 that defines the valve inner surface 108.

The anchor 150 may include an anchor outer surface 155 and a tapered anchor inner surface 165. The tapered inner surface 165 may include an inner diameter that decreases along a length of the anchor 150. In one embodiment, the angle of the tapered inner surface 165 may correspond to and be substantially the same (within +/−10%) as the angle of the tapered outer surface 118 of the valve body 105. The tapered anchor inner surface 165 may include an inner diameter 168 at an anchor upper portion 154 that may be greater than a diameter of the tapered outer surface 118 of the valve body 105 at its smallest outer diameter. Accordingly, when the anchor 150 and the valve body 105 are inserted into the nipple 10 from opposite ends and pushed together using opposing forces 170 and 175, the anchor 150 may slide over the valve outer surface 106. The valve body 105 and the anchor 150 may be pre-installed in the nipple 10 prior to being inserted within the tubing string and sent downhole.

Figure 3:
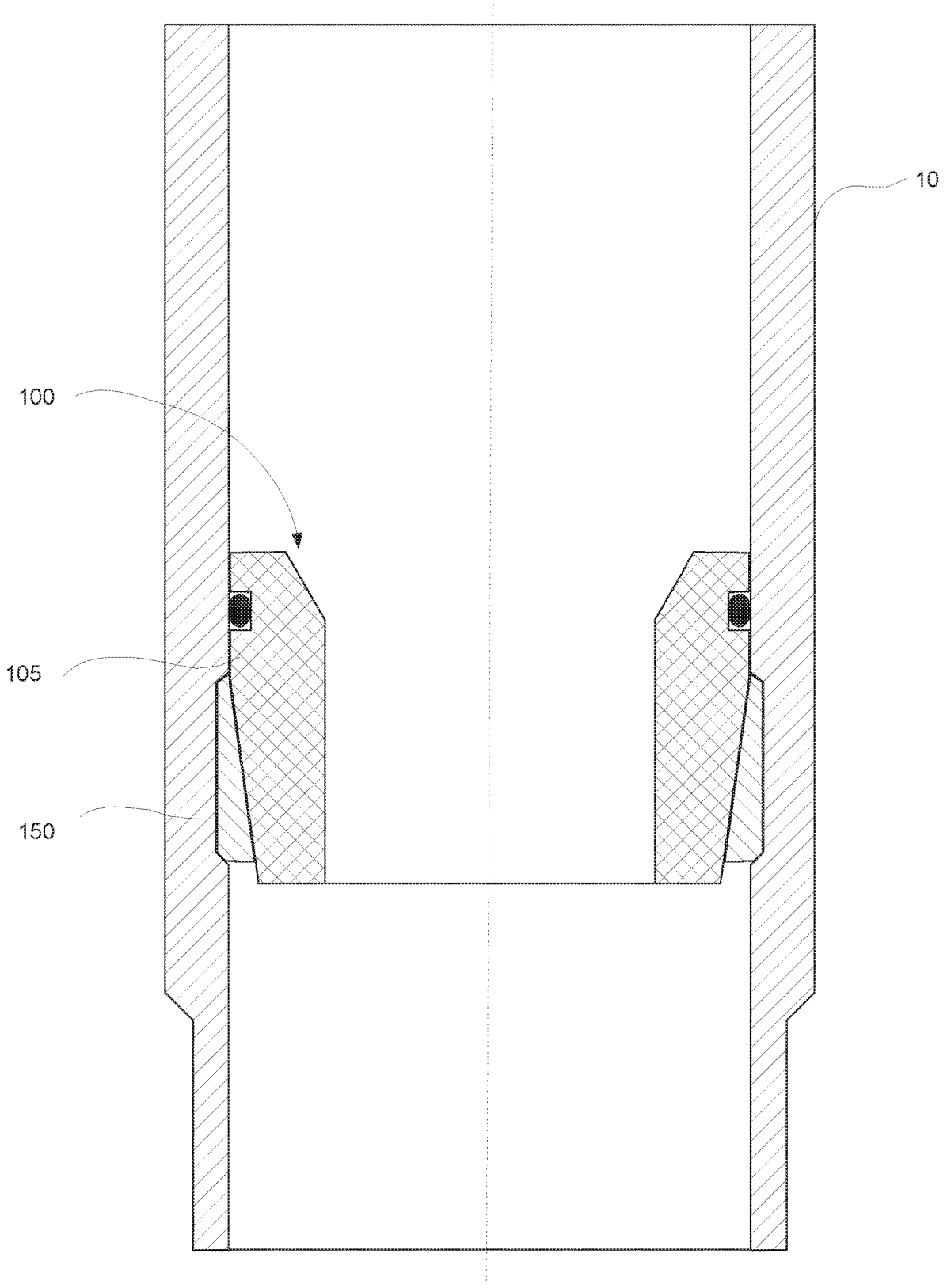
FIG. 3 is a cross-sectional view of the apparatus of FIG. 1 when the apparatus is locked into a nipple and prior to the device being actuated, according to one or more embodiments disclosed herein.

In one embodiment, once the valve body 105 and the anchor 150 are inserted into the nipple 10, a setting tool may apply opposing forces 170 and 175 on the valve body 105 and the anchor 150, respectively, in order to push the valve body 105 and the anchor 150 together and set the dissolvable valve 100 in the nipple 10. As the valve body 105 is pushed down and the anchor 150 is pushed up using the opposing forces 170 and 175, respectively, the anchor 150 may be radially expanded as the tapered outer diameter 118 of the valve body 105 forces the tapered inner diameter 154 of the anchor 150 outward. The tapered inner surface 165 of the anchor 150 may follow the tapered outer surface 118 of the valve body 105 as the anchor 150 radially expands until the anchor outer surface 155 expands to fit within the groove 25 of the nipple 10, as shown in FIGS. 2 and 3. In one embodiment, the anchor 150 may include a length 152 that may be received either entirely or in part by the groove 25 of the nipple 10. The application of the opposing forces 170 and 175 to the valve body 105 and the anchor 150, respectively, result in an interference fit between the valve body 105 and the anchor 150, which allows the valve body 105 and the anchor 150 to be affixed to one another via a friction fit, and the dissolvable valve 10 may be affixed to the nipple 10. In one embodiment, either or both the valve outer surface 106 and the anchor inner surface 165 may include teeth (not shown) to provide extra friction to hold the valve body 105 and the anchor 150 together.

After the dissolvable valve 100 is mounted within the nipple 10, the nipple may be positioned in the tubing string below the portion of tubing string needing isolation in an oil and gas well. In one embodiment, the portion of tubing string needing isolating may include a packer. In one embodiment, fluid may freely flow through the dissolvable valve 100 before the dissolvable valve 100 has been actuated.

FIG. 4 is a cross-sectional view of a system 200 for isolating a portion of tubing string (not shown), according to one or more embodiments disclosed herein. As discussed the portion of tubing string needing isolation may include a packer. When the portion of tubing string needs to be isolated, or the packer needs to be hydraulically actuated, the dissolvable valve 100 may be actuated by dropping the ball 190 downhole in the tubing to seat on the ball seat 125 of the dissolvable valve 100. In one embodiment, the system 200 may include the nipple 10, the dissolvable valve 100 affixed to the nipple 10, and the ball 190 seated on the ball seat 125 of the dissolvable valve 100. In one embodiment, the ball 190 may be constructed from a dissolvable material. When the ball 190 is seated on the dissolvable valve 100, fluid may be prevented from flowing past the dissolvable valve 100 to a second portion of tubing string downhole from the portion of tubing string or packer needing isolation. However, in the event pressure is greater below the dissolvable valve 100, fluid may displace the ball 190 and relieve the pressure in the second portion of tubing string by allowing fluid to flow through the dissolvable valve 100.

As wellbore fluids come in contact with the dissolvable valve 100 and the ball 190, the dissolvable valve 100 and the ball 190 may completely dissolve. After the dissolvable valve 100 and the ball 190 are dissolved, the nipple 10 may be left without any restriction. In addition, no wireline is required to pull the dissolvable valve 100 from the nipple 10 which reduces operation time and costs, as well as avoids other potential issues associated with running wirelines.

Figure 5:
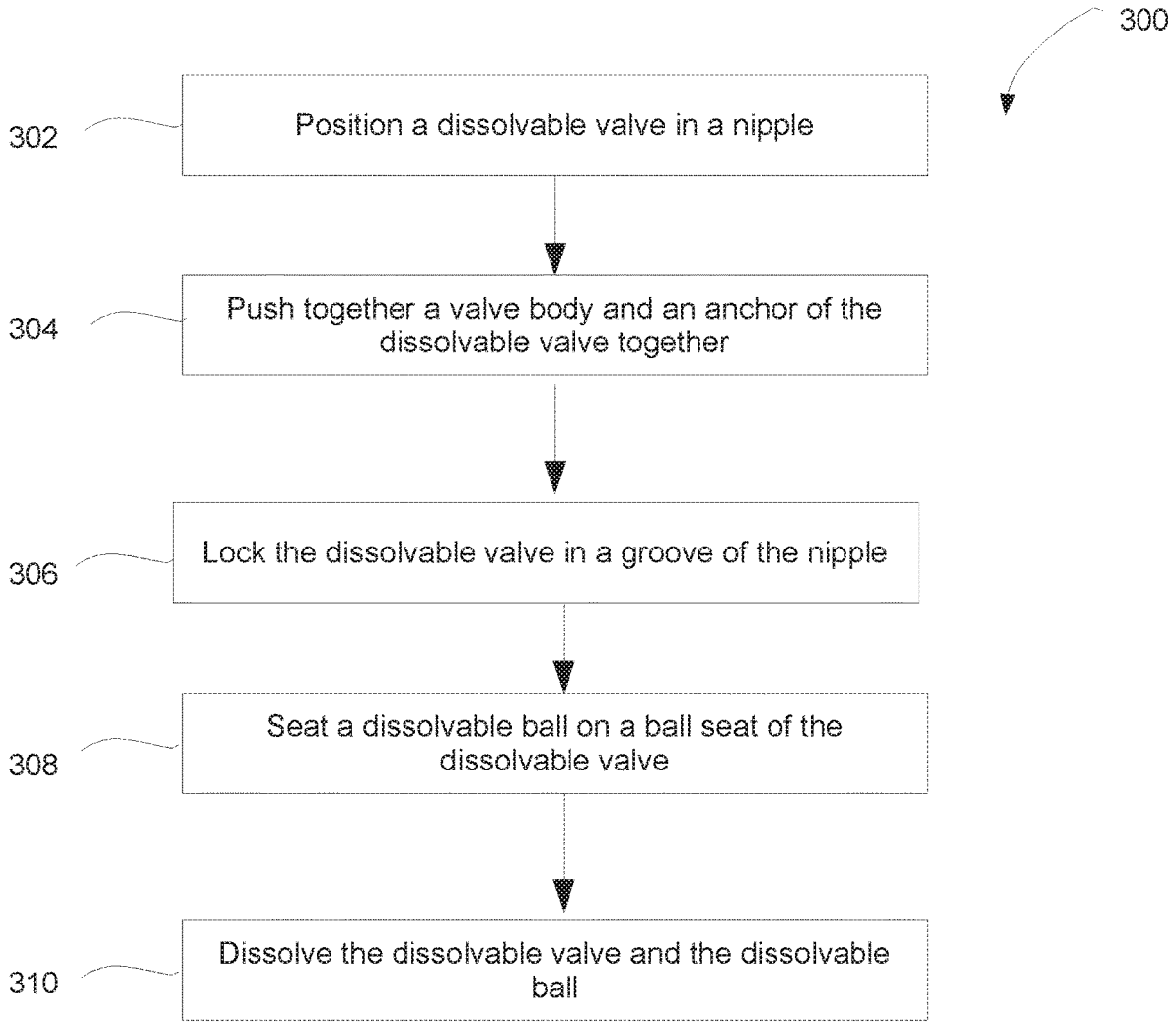
FIG. 5 is a flowchart depicting a method for isolating a portion of tubing string, according to one or more embodiments disclosed herein.

In one embodiment of the invention, a method 300 for isolating a portion of tubing string in a hydrocarbon well is also contemplated and shown in FIG. 5. In step 302, a dissolvable valve may be positioned within a nipple. The dissolvable valve may include a valve body and an anchor that are pushed together from opposite ends in step 304. The dissolvable valve may be locked in a groove of the nipple in step 306. In step 308, a dissolvable ball may be seated on the dissolvable valve, which isolates a casing or a second portion of tubing below the dissolvable valve from the portion of tubing string. In step 310, the dissolvable ball and the dissolvable valve may be dissolved by wellbore fluids.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A valve for isolating a portion of tubing string in a hydrocarbon well, comprising:
   - a valve body that includes a ball seat and a tapered outer surface;
   - an anchor that is positioned on the valve body, the anchor configured to position the valve within a nipple that is positioned below the tubing string and including a tapered inner surface that conforms to the tapered outer surface; and
   - a ball that is configured to seat on the ball seat of the valve body, wherein the valve body, the anchor, and the ball are constructed from a dissolvable material.

2. The valve of claim 1, wherein the ball is seated on the ball seat after the valve is run downhole.

3. The valve of claim 1, wherein the valve body and the anchor are pushed together from opposite ends, thereby providing a friction fit between the valve body and the anchor.

4. The valve of claim 1, wherein the portion of tubing string is isolated from a second portion of tubing disposed below the tubing string when the ball is seated on the ball seat.

5. The valve of claim 1, wherein the dissolvable material of the valve body, the anchor, and the ball is configured to dissolve upon contact with wellbore fluids in the hydrocarbon well.

6. The valve of claim 1, wherein the dissolvable material includes polyglycolic acid.

7. The valve of claim 1, wherein the dissolvable material includes a magnesium aluminum alloy.

8. The valve of claim 1, wherein the dissolvable material includes an aluminum alloy.

9. A system for isolating a portion of tubing string in a hydrocarbon well, comprising:
   - a nipple including an inner surface that defines a groove;
   - a dissolvable valve including:
     - a valve body that includes a ball seat and a tapered outer surface; and
     - an anchor that is positioned on the valve body and fits in the groove of the nipple and including a tapered inner surface that conforms to the tapered outer surface; and
   - a dissolvable ball configured to seat on the ball seat.

10. The system of claim 9, wherein the portion of tubing string is isolated from a second portion of tubing disposed below the portion of tubing string when the ball is seated on the ball seat.

11. The system of claim 10, wherein wellbore fluids in the hydrocarbon well dissolve the dissolvable valve and the dissolvable ball.

12. The system of claim 10, wherein the dissolvable valve and the dissolvable ball include polyglycolic acid.

13. The system of claim 10, wherein the dissolvable valve and the dissolvable ball include a magnesium aluminum alloy.

14. The system of claim 10, wherein the dissolvable valve and the dissolvable ball include an aluminum alloy.

15. The system of claim 10, wherein the dissolvable valve is installed in the nipple before the nipple is run downhole.

16. The system of claim 10, wherein the dissolvable ball is seated on the ball seat after the dissolvable valve is run down hole, and the fluid may flow through the dissolvable valve in both directions until the dissolvable ball is positioned on the ball seat.

17. A method for isolating a portion of tubing string in a hydrocarbon well, comprising:

positioning a dissolvable valve within a nipple, the nipple including an inner surface defining a groove and the dissolvable valve including:

a valve body that includes a ball seat and a tapered outer surface; and an anchor that is positioned on the valve body and fits in the groove of the nipple and including a tapered inner surface that conforms to the tapered outer surface;

positioning the nipple below the portion of tubing string in the hydrocarbon well; and seating a dissolvable ball on the ball seat.

18. The method of claim 17, further comprising installing the dissolvable valve within the nipple before the nipple is sent downhole.

19. The method of claim 17, further comprising allowing fluid to flow through the dissolvable valve in both directions until the dissolvable ball is seated on the ball seat.

* * * * *